United States Patent [19]

Kocher

[11] Patent Number: 4,974,422

[45] Date of Patent: Dec. 4, 1990

[54] EVAPORATIVE CONDENSER WITH FOGGING NOZZLE

[75] Inventor: Erich J. Kocher, Milwaukee, Wis.

[73] Assignee: Vilter Manufacturing Corporation, Milwaukee, Wis.

[21] Appl. No.: 490,789

[22] Filed: Mar. 8, 1990

[51] Int. Cl.[5] ..... F28D 5/00

[52] U.S. Cl. ..... 62/305; 261/153; 62/311

[58] Field of Search ..... 62/304, 305, 183, 311; 261/152, 153; 165/900

[56] References Cited

U.S. PATENT DOCUMENTS

| | | | |
|---|---|---|---|
| 2,724,246 | 11/1955 | Lowe | 62/305 |
| 3,169,575 | 2/1965 | Engalitcheff, Jr. et al. . | |
| 4,028,906 | 6/1977 | Gingold et al. . | |
| 4,501,121 | 2/1985 | Izumi . | |
| 4,755,331 | 7/1988 | Merrill et al. | 261/153 |

*Primary Examiner*—Albert J. Makay
*Assistant Examiner*—John Sollecito
*Attorney, Agent, or Firm*—Nilles & Nilles

[57] ABSTRACT

An evaporative condenser cools and condenses fluid, such as refrigerants in a refrigeration system, by circulating the fluid through a condensing coil, continuously and completely spraying the condensing coil from above with cooling water, and simultaneously blowing air from below the condensing coil upwardly and counter to the cooling water. Heat is transferred from the fluid to the cooling water, and heat is transferred by evaporation from the cooling water to the air and is discharged to the atmosphere. A fogging nozzle sprays a fine water mist into the air blowing into and through the condenser, which will increase the rate of evaporation and therefore increase the rate of heat transfer, thus increasing the cooling efficiency of the condenser.

7 Claims, 1 Drawing Sheet

EVAPORATIVE CONDENSER WITH FOGGING NOZZLE

BACKGROUND OF THE INVENTION

1. Field of the Invention

The invention disclosed in this patent relates to an evaporative condenser for cooling and condensing fluids, such as refrigerants in a refrigeration system. The invention incorporates a fogging nozzle for spraying a fine water mist into an evaporative condenser, which will increase the rate of evaporation of cooling water circulating in the condenser, and thus increase the cooling efficiency of the condenser.

2. Description of the Related Art

An evaporative condenser is an integral part of a refrigeration system since it is the device which cools and condenses the refrigerant in the system. The general principles of operation of an evaporative condenser are described, for instance, in *Equipment Handbook*, Chapter 16 (1983 Edition). The principal components of an evaporative condenser usually include a condensing coil, fan, water reservoir, spray distribution system, water pump, and make-up water supply.

In a typical evporative condenser, the refrigerant is circulated through the condensing coil which is located at the midsection of the condenser. The condensing coil is continually wetted on its outer surfaces by recirculating cooling water pumped from the reservoir at the bottom of the condenser up to the spray distribution system located above the condensing coil. Cooling water from the spray distribution system flows down over the condensing coil. Heat is transferred from the refrigerant, through the wall of the pipes of the condensing coil, and to the cooling water, thereby cooling and condensing the refrigerant flowing through the condensing coil. The spray distribution system provides complete and continuous wetting of the condensing coil to ensure a high rate of heat transfer and to prevent a buildup of residue or scale, which is more likely to occur if the condensing coil is intermittenly or partially wetted.

Cooling water leaving the condensing coil drops down to the reservoir where it is pumped back up through the spray distribution system. Cooling water continuously circulates through an evaporative condenser in this manner, cooling and condensing the refrigerant which continuously flows through the condensing coil.

The fan is located at the lower portion of the condenser, between the condensing coil and reservoir, and takes air from the atmosphere and blows it into the condenser. The air is blown upward through the condensing coil where it causes a portion of the cooling water to evaporate. The cooling water is itself cooled by evaporation, which transfers heat from the cooling water to the air. The air exits to the atmosphere through an air discharge opening at the top of the condenser, and the heat released by evaporation is blown out with the air.

An evaporation condenser therefore transfers heat from the refrigerant to the cooling water, and from the cooling water to the air, discharging the heat to the atmosphere.

Some efforts have been made to increase the efficiency of an evaporative condenser by employing various techniques of heat transfer. For instance, U.S. Pat. No. 3,169,575 states that in the area between the spray distribution system and the top of the condensing coil the cooling water actually absorbs heat from the air. The patent shows cooling water and refrigerant being first pumped through a heat exchanger where some heat from the refrigerant is transferred to the cooling water; cooling water is then directed to the spray distribution system where it is sprayed over the condensing coil. The heat exchanger is intended to adjust the relative temperatures of the cooling water and the air so that, in the area between the spray distribution system and the condensing coil, the cooling water will be cooled by the counterflowing air rather than taking up heat from the air. While the heat exchanger may affect the relative temperature of the cooling water and air above the condensing coil, it otherwise does not affect the rate of evaporation of the cooling water as it passes over and through the condensing coil.

Fogging nozzles have been used on some types of cooling equipment, but not evaporative condensers. For example, U.S. Pat. No. 4,028,906 shows a fogging nozzle for injecting an atomized mist into an air conditioning compressor, but says that it is undesirable to douse the coil with more water than will evaporate, which is what occurs in an evaporative condenser. As another example, U.S. Pat. No. 4,501,121 shows a fogging nozzle in a refrigeration system, but it is used to spray atomized water into the cooling air which circulates within the refrigerated chamber; the nozzle does not spray water into the atmospheric air used to transfer heat from the refrigerant to the atmosphere as in an evaporative condenser.

SUMMARY OF THE INVENTION

The object of the invention is to increase the cooling efficiency of an evaporative condenser by adding a fogging nozzle which sends a fine water mist of tiny water particles into the upwardly flowing air, which increases the rate of evaporation of the water flowing down from above the condensing coil, thus increasing the heat transfer capacity of the condenser.

The evaporation taking place in an evaporative condenser of the type described above naturally uses up a certain amount of cooling water, depleting the resevoir. For this reason make-up water is supplied from an outside source, typically from a municipal water supply or an equivalent, to replenish the resrvoir. A float valve maintains the water in the reservoir at a desired level.

The water supply for the make-up water, which is under pressure, can also be used to spray a fine water mist or fog of tiny water particles onto the upwardly flowing air. Water spraying by fogging nozzles as tiny particles evaporates at a higher rate than the water flowing down from the spray distribution system, which generally flows as a stream of water or, at least, flows downward as relatively large water droplets. The fine water mist, by virtue of its tiny particles, will increase the overall rate of evaporation of the cooling water flowing down, which will increase the overall heat transfer from the cooling water to the air so that a greater amount of heat may be discharged from the condenser. Since more heat may be transferred out of the cooling water, more heat may also be transferred out of the refrigerant. Increasing the rate of evaporation of the cooling water will therefore increase the cooling efficiency of the evaporative condenser.

Evaporation leaves residue or scale on the condensing coil. If the scale is allowed to build up, it will cause a decrease in heat transfer efficiency. Tiny water particles, as mentioned, have a higher rate of evaportion, and will therefore produce a large amount of scale, so using only a mist of tiny water particles to cool the condensing coil may actually be counterproductive. The spray of a relatively large volume of cooling water washes away scale which would build up due to evaporation, as well as cool and condense the refrigerant in the condensing coil.

The present invention therefore will provide a shower of a large volume of cooling water to sufficiently cool and condense the refrigerant in the condensing coil and wash away scale deposited through evaporation, yet also will provide a fine water mist of relatively tiny water particles to provide the most efficient evaporation.

The fogging nozzles therefore increase the cooling efficiency of a conventional evaporative condenser without adding to the size of the condenser. The efficiency is increased by use of a water supply which is already connected to the unit so the cost involves only the cost of the fogging nozzle, and no additional power to the unit is needed. Furthermore, the fogging nozzle adds fresh water to the system, even though only a small amount, which results in a lower net concentration of scale.

DESCRIPTION OF THE PREFERRED EMBODIMENT

Figure 1:
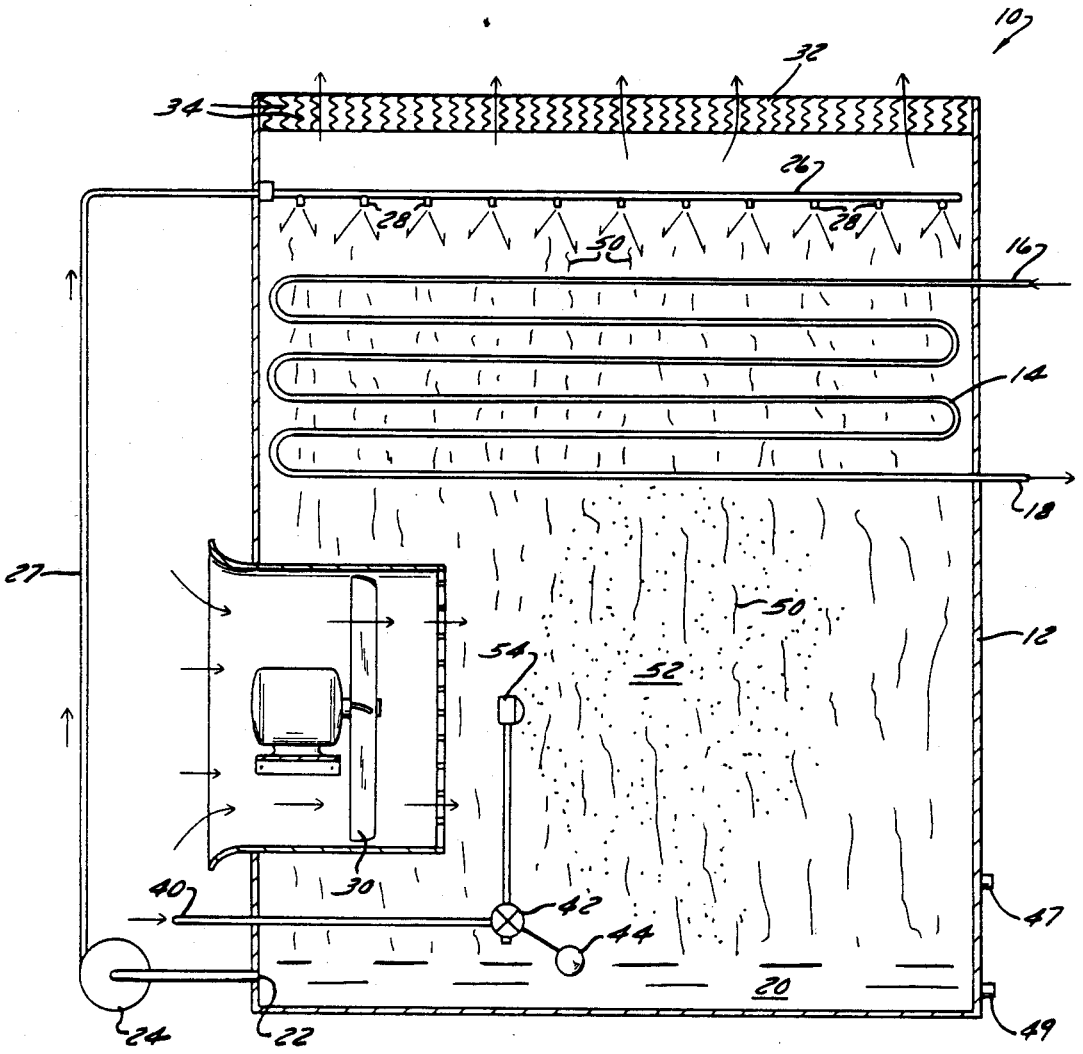
FIG. 1 is a cross-sectional view of an evaporative condenser incorporating a fogging nozzle according to the principles of the invention.

An evaporative condenser 10 has a large vertical body or tank 12. A refrigerant enters the condenser 10 through a refrigerant inlet 16, flows through a condensing coil 14 in the midsection of the condenser 10, then exits through a refrigerant outlet 18. The refrigerant normally enters the condenser as a vapor and exits as a liquid. The condensing coil 14 is made of steel pipes pitched to facilitate complete and free draining to reduce liquid hang-up, each segment having short circuit length to increase efficiency by reducing the load per circuit. The pipes are in a staggered arrangement so as to require the cooling water and the air to wind their way through the condensing coil 14 amd maximize the interaction between the surface of the condensing coil 14 with the cooling water and air.

Water in a reservoir 20 at the bottom of the condenser 10 is drawn through an outlet 22, goes through a pump 24 and is pumped up a conduit 27 to a spray distribution system 26. The spray distribution system 26 is located above the condensing coil 14 and has spray nozzles 28 which shower a relatively large volume of cooling water 50 onto the coil bank 14. The spray distribution system 26 provides full coverage of cooling water 50 over the condensing coil 14, and the spray nozzles 28 are quiet, nonclogging, and corrosion and rust resistant. The cooling water 50 from the spray distribution system 26 travels downward and through the condensing coil 14, and eventually flows down into the reservoir 20, where the water then circulates back up through the spray distribution system 26. Cooling Water is continuously circulated in this manner. When the cooling water 50 contacts the condensing coil 14, heat transfers from the refrigerant in the condensing coil 14 to the cooling water 50.

A fan 30 at the lower portion of the condenser 10, at a point between the reservoir 20 and condensing coil 14, pulls air from the atmosphere and blows it into the condenser 10 in an upward direction against and through the condensing coil 14 then out through an air discharge opening 32 at the top of the condenser 10. The fan 30 may be either a propeller-type or centrifugal-type fan. The upward flowing air evaporates some of the cooling water 50 flowing downward. The evaporative condenser 10 cools the refrigerant flowing through the condensing coil 14 by transferring heat from the refrigerant to the cooling water 50 showering down over the condensing coil 14, and transfers heat by evaporation from the cooling water 50 to the air blowing up through the condenser 10, discharging the heat to the atmosphere.

Since evaporation during operation of the condenser 10 consumes a certain portion of water, a water supply 40 for make-up water to the reservoir 20 is attached, and is typically a municipal water line or other water source under pressure. Attached to the water supply 40 is a float valve 42,44 for regulating the water level in the reservoir 20. A float valve 42,44 rests on the surface which in effect reads the level of water in the reservoir 20, and is of the proper type and size so that it adds make-up water to the reservoir 20 at the approximate rate that water is evaporation and being discharged to the atmosphere. The float valve 42,44 therefore continuously seeks to maintain the reservoir at the appropriate level.

Also attached to the water supply 40 is one or more fogging nozzles 54. The fogging nozzle 54 directs a fine water mist or fog 52 in an upward direction, where the mist 52 intermingles with the air being blown into the condenser 10 by the fan 30. Municipal water lines are under pressure typically in the order of about twenty psi or more, although any water source having pressure high enough to spray a fine water mist or fog 52 from the fogging nozzle 54 is sufficient.

The fogging nozzle 54 should be selected so that, given the pressure of the water supply 40, the fogging nozzle 54 will produce a fine water mist 52.

The mixture of air and fine water mist 52 travels up the condenser 10, and is blown against and through the condensing coil 14. The fine water mist 52 mixes with the cooling water 50 flowing down from the spray distribution system 26. Since the size of the water particles of the fine water mist 52 are relatively tiny, the rate of evaporation of the water in the system and thus the rate of heat transfer is increased over that of a condenser 10 having no fogging nozzle 54.

The condenser 10 also has noncombustible vinyl drift eliminators 34 typically located between the spray distribution system 26 and the air discharge opening 32 to recover some moisture from the air to reduce drift.

The condenser 10 also has a bottom drain 49 for easily and completely draining the resrvoir 20 during cleaning. An overflow opening 47 is inserted on the side of the tank 12 in case water in the reservoir 20 reaches too high a level. The individual parts of the system are zinc-plated to protect against corrosion.

I claim:

1. An evaporative condenser comprising:

a condensing coil for cooling and condensing a fluid flowing therethrough;

a reservoir below said condensing coil for holding cooling water;

means for spraying said cooling water from above said condensing coil downward against and past said condensing coil and into said reservoir;

means for directing an airstream into said condenser between said reservoir and said condensing coil, and for directing said airstream upwardly against and past said condensing coil;

an air discharge opening above said condensing coil for discharging said airstream;

means located below said condensing coil for spraying fine water mist upwardly into and intermingling with said airstream so that said fine water mist collects on said condensing coil and mixes with said cooling water;

and means for supplying water under pressure from a source other than said cooling water in said reservoir to supply make-up water to said reservoir and to supply water for said means for spraying fine water mist.

2. An evaporative condenser according to claim 1, wherein said means for spraying fine water mist comprises a fogging nozzle which sprays tiny water particles.

3. An evaporative condenser according to claim 1, wherein said means for directing an airstream into said condenser comprises a propeller-type fan.

4. An evaporative condenser according to claim 1, wherein said means for directing an airstream into said condenser comprises a centrifugal-type fan.

5. An evaporative condenser according to claim 1, wherein said means for spraying cooling water comprises spray nozzles located above said condensing coil.

6. An evaporative condenser according to claim 5, further comprising a pump and conduit for pumping cooling water from said resrvoir up to said spray nozzles.

7. An evaporative condenser according to claim 1, further comprising drift eliminators located between said means for spraying cooling water and said air discharge opening.

* * * * *